United States Patent [19]

Schupphaus

[11] Patent Number: 4,955,668

[45] Date of Patent: Sep. 11, 1990

[54] DRUM CUTTER-LOADER EQUIPPED WITH AN AUXILIARY DRUM

[75] Inventor: Herbert Schupphaus, Bochum, Fed. Rep. of Germany

[73] Assignee: Gebr. Eickhoff Maschinenfabrik u. EisenieBerei mbg, Bochum, Fed. Rep. of Germany

[21] Appl. No.: 363,625

[22] Filed: Jun. 8, 1989

[30] Foreign Application Priority Data

Jun. 24, 1988 [DE] Fed. Rep. of Germany ..... 3821307

[51] Int. Cl.[5] ..... E21C 25/08; E21C 35/20

[52] U.S. Cl. ..... 299/42; 299/53

[58] Field of Search ..... 299/29, 42, 43, 45, 299/52, 53, 54

[56] References Cited

U.S. PATENT DOCUMENTS 4,465,319 8/1984 Brownlie ..... 299/42

FOREIGN PATENT DOCUMENTS 3331920 4/1984 Fed. Rep. of Germany .
3527253 11/1986 Fed. Rep. of Germany .
3736609 5/1989 Fed. Rep. of Germany .
5376902 12/1976 Japan .
2132256 7/1984 United Kingdom ..... 299/42
2209779 5/1989 United Kingdom ..... 299/42

*Primary Examiner*—Stephen J. Novosad
*Assistant Examiner*—David J. Bagnell
*Attorney, Agent, or Firm*—Clifford A. Poff

[57] ABSTRACT

A drum cutter-loader mining machine equipped with an auxiliary debris crushing drum. The machine includes a cutter drum support arm and an auxiliary drum jib which are independently pivotable about a common pivot axis. The device further includes means for driving the auxiliary drum through a gearing communication between the auxiliary drum and the motor used for driving the cutting drum.

9 Claims, 2 Drawing Sheets

DRUM CUTTER-LOADER EQUIPPED WITH AN AUXILIARY DRUM

BACKGROUND OF THE INVENTION

1. Field of the Invention

The present invention relates to a drum cutter-loader longwall mining machine, in general, and to a drum cutter-loader longwall mining machine equipped with a rotatable auxiliary debris crushing drum, in particular.

2. Description of the Prior Art

Japanese Published Patent Specification No. 53-76 902 discloses a coal-crushing device for a mining machine which includes a crushing roll rotatably supported at a first end of a support arm which is mounted to an end of the mining machine body and above a longwall conveyor. The second end of the support arm carries a driving motor and is pivotally connected to the machine body. The crushing roll is driven by the driving motor via gearing which is on the inside of the support arm. The axis of the driving motor, which serves only for driving the crushing roll, lies coaxially with the swivelling or pivoting axis of the crushing roll support arm. This same axis is also coaxial with the pivot axis of the cutting drum support arm, which besides a cutting drum also carries a separate motor and gearing for driving the cutting drum.

German patent application No. P 37 36 609.2 describes a similar cutter-loader machine used in the mining of thick seams which is also equipped with an auxiliary drum to crush mined debris. The machine includes cutting drums situated at both ends of the machine body which are retained by separate height-adjustable and pivotally-mounted support arms. Each of the cutting drums is driven by a separate drive motor mounted on the goaf side of each of the respective support arms. The auxiliary crushing drum, which is fixed to the front of the machine body, is connected by gearing to one of the driving motors. In one embodiment, the auxiliary drum is rotatably supported by a shoulder of the support arm which spans the support arm pivot axis. In a second embodiment, the auxiliary drum is rotatably supported by a jib which is rigidly fastened to the rear end of the protective housing which encloses the driving motor of the cutting drum. In either embodiment, however, the auxiliary drum is caused to be raised and/or lowered through the pivoting action of the support arm to which the auxiliary drum is directly or indirectly integrally secured. The auxiliary drum does not pivot independently of its associated support arm.

Modern cutter-loaders, on account of their great power requirements, must be provided with powerful driving motors which have correspondingly large physical dimensions. Since the motors considerably influence the overall dimensions of the machine body, they are frequently arranged outside the machine body on the support arms of the cutter-loader, above the longwall conveyor means. This particular motor mounting arrangement results in an advantageous lowering in the overall height of the machine body while avoiding an undesirable reduction of the machine gate space caused by encroachment of the driving motor housing into the gate space. The machine gate space being that space of the machine body through which mined debris carried on the conveyor may pass. However, such a construction prohibits the driving motor from being fixed coaxially with the pivot axis of the support arm. In such "low height" devices, the installation of a second drive motor for driving the auxiliary drum is required and can only be achieved on those machines having very long support arms for the cutting drum and the auxiliary drum. Support arms of such dimensions not only considerably increase the overall length of the cutter-loader, but also increase the manufacturing costs and thus the price which has to be paid for such machines.

Occasionally it is desired to supply the auxiliary drum with driving power corresponding to the full driving power of the cutting drum, which has proved to be especially advantageous in maintaining continuous underground mining operations. When such high power is desired, the only course of action, for reasons of space, is to connect the driving motor of the cutting drum to the auxiliary drum by gearing. Only through direct connection with such a power supply is it ensured that the auxiliary drum will operate continuously and unblocked thus avoiding interruption of the mining operation where debris suddenly occurs on the conveyer.

The cutter-loader disclosed in previously mentioned German patent application No. P 37 36 609.2 provides for the driving of the auxiliary drum with the driving motor of the cutting drum. The auxiliary drum is rotatably supported by a jib which is rigidly connected to the driving motor. The driving motor is secured to the support arm and its driving axis is arranged outside or offset from the support arm pivot axis. The geared communication between the auxiliary drum and the driving motor is effected by a gear train situated either in the jib or in a shoulder of the support arm. Since the axis of the driving motor lies outside the support arm pivot axis and the auxiliary drum is rigidly connected to the driving motor via the jib, the auxiliary drum is essentially integrally connected with the support arm and participates in the pivoting movement thereof. Therefore, the height position of the auxiliary drum is dependent on, and controlled by, the height position of the cutting drum support arm.

Such unwanted variations in the position of the auxiliary drum can be eliminated by a pivotable mounting of the auxiliary drum jib on the free front end of the driving motor with the aid of an elaborate servo drive mechanism, as German Pat. No. 35 27 253 shows. However, inclusion of such a mechanism increases the construction and maintenance costs of the machine. Still further, the addition of such a servo drive mechanism for independently controlling the height of the auxiliary drum does not solve the problem of conserving the overall length of the machine, since, as German Pat. No. 35 27 253 illustrates, the jib pivot axis is disposed offset and forwardly of the support arm pivot axis as a result of the space which must be provided in order to account for the structural elements of the servo mechanism.

It is therefore an object of the invention to provide a longwall mining machine of the type having a cutting drum and an auxiliary crushing drum associated therewith which are driven through a positive geared communication with cutting drum driving motor.

It is a further object of the invention to provide a longwall mining machine of the type having a cutting drum and an auxiliary crushing drum associated therewith in which the support arm of the cutting drum and the jib of the auxiliary drum are independently adjustable in height.

It is a further object of the invention to provide a longwall mining machine of the type having a cutting drum and an auxiliary crushing drum associated therewith in which the support arm of the cutting drum and the jib of the auxiliary drum are pivotable about the same pivot axis.

It is a still further object of the invention to provide a longwall mining machine of the type having a cutting drum and an auxiliary crushing drum associated therewith which is compact in size and relatively simple to construct and maintain.

Still other objects and advantages will become apparent when one considers the attached drawings and the description of the invention presented hereinbelow.

SUMMARY OF THE INVENTION

The present invention seeks to overcome the disadvantages of cutter-loader mining machines of the type having at least one cutting drum and an auxiliary crushing drum associated therewith. The invention proposes that the support arm of the cutting drum and the jib of the auxiliary drum be pivotally but separately mounted about a common pivoting axis and that a gearing element be provided which is arranged coaxially with the pivoting axis which produces the geared communication between the auxiliary drum and the driving motor of the cutting drum. With such a construction there is provided a directly geared communication between the auxiliary drum and the driving motor of the cutting drum as well as pivotable mountings of the cutting drum and the auxiliary drum which are completely independent of each other. As a result, variations in the working level of the cutting drum which are caused by shifting of the support arm do not affect the position of the auxiliary drum and do not vary its operating position.

In one embodiment of the invention, the gear train of the support arm providing the geared connection between the driving motor and the cutting drum is advantageously extended beyond the axis of the driving motor and as far as the pivoting axis of the support arm. Consequently, the rotary movement of the driving motor is simultaneously communicated both to the cutting drum and also the auxiliary drum via the gearing element provided therebetween, which is arranged coaxially with the common pivoting axis.

With this embodiment, it is preferred that a rotationally elastic communication between the last gearing element of the support arm gear train and the first gearing element of the jib gear train be produced with the aid of a torsion bar, in order to cushion loading shocks and keep them away from the driving motor.

In a second embodiment of the invention, the driving motor or the housing enclosing the driving motor is equipped at its goaf-sided end, which is opposite to the support arm and closest to the jib, with a housing shoulder which acts in an articulated manner on the pivoting axis. The housing shoulder is provided with gearing elements which connect the goaf-sided output shaft butt of the driving motor to a jib gear which is arranged centrally to the pivoting axis. In this way, the greater part of the pivoting axis is kept free from the transmission of the driving power being supplied to the auxiliary drum and produces a more direct geared communication between driving motor and auxiliary drum.

With either embodiment however, under extreme loading requirements by the auxiliary drum, the full driving power of the high-power driving motor is available to the auxiliary drum without its effectiveness and motion being restricted by the pivoting movements of the support arm of the cutting drum.

The invention further provides a bipartite pillow block which is located at an end of the machine body for pivotally retaining the support arm of the cutting drum and the jib of the auxiliary drum. The bipartite pillow block is formed of two half-shells which are divided across their diameter and along their length and which are connectable to one another by fasteners. The pillow block is provided with a through-bore which runs through the center of and axially along the half-shells, coaxially with the pivoting axis, and which at both ends thereof turns into a bore section of larger diameter. Each of the enlarged diameter bore sections serve to accept a gudgeon projecting laterally both from the support arm and the jib, such gudgeons projecting into the respective enlarged bore section and being fixed in axial direction therein. By means of these gudgeons, the support arm, the jib, and the housing shoulder of the driving motor are pivotally supported in the pillow block.

DESCRIPTION OF THE PREFERRED EMBODIMENTS

Figure 1:
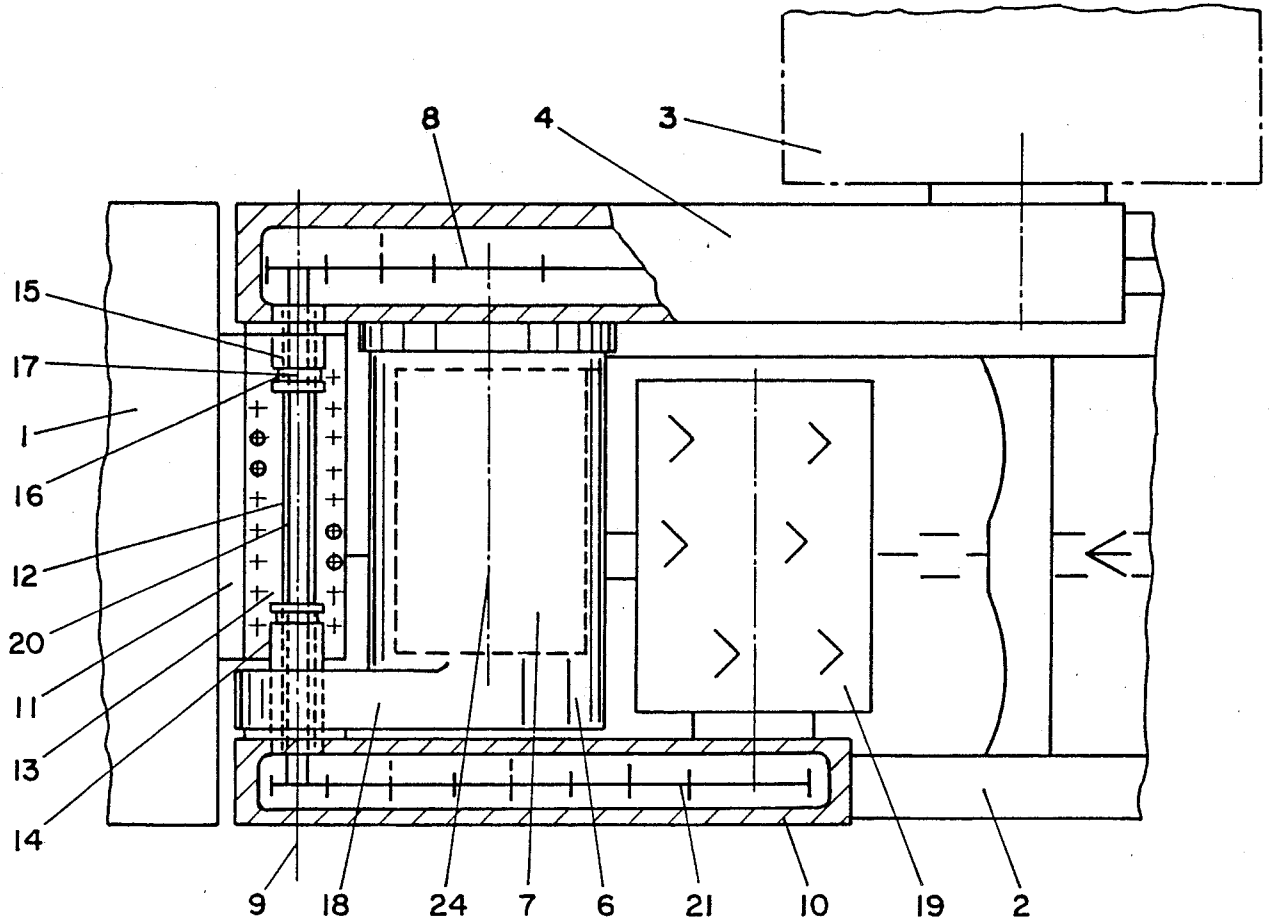
FIG. 1 is a partially cut-away plan view of a first embodiment of the cutter-loader of the present invention.

Referring to FIG. 1, there is shown a cutter-loader 1 which can be driven above and along a longwall conveyor 2 by conventional drive means (not shown). The cutter-loader 1 breaks down the existing mine seam with its cutting drum 3. A vertically pivotable support arm 4 mounted to the leading end of the cutter-loader machine body rotatably supports on its coal face side, the cutting drum 3. On its opposite or "goaf" side the support arm 4 supports a protective housing 6 which accommodates a cutting drum driving motor 7. A gear train 8 housed inside the support arm 4 constitutes a geared connection between the driving motor 7 and a reduction gear (not shown) which is inside the cutting drum 3. An axis 9, which is parallel to the mine floor and is pointed toward the coal face, forms the pivoting axis of the support arm 4. At the same time, the axis 9 also serves as the pivoting axis of a jib 10 which is mounted, like support arm 4, to the leading end of the cutter-loader machine body. The jib 10 is located roughly above the goaf-sided wall of the longwall conveyor 2. At its forwardmost end the jib 10 rotatably supports an auxiliary debris crushing drum 19 which essentially straddles the longwall conveyor 2. The auxiliary drum 19 acts to crush any oversized debris carried on the longwall conveyor to a size which would permit passage of the debris through the gate space of the cutter-loader machine body.

A pillow block 11 also mounted to the leading end of the machine body is situated between support arm 4 and jib 10 and retains both so that they can be pivoted about the axis 9. The pillow block 11 is bipartite in construction and is formed of two half shells 13 which are divided across their diameter and along their length and which are connectable to one another by suitable fasteners. When the two half-shells 13 of the pillow block are connected together there is formed a through-bore 12 in the pillow block 11 which extends along the entire length thereof. The through-bore 12 is coaxial with the pivoting axis 9. At both ends thereof, the bore 12 is provided with bore sections 14 of larger diameter than the remainder of the bore 12.

Gudgeons 15 which project inwardly from opposed lateral surfaces of the support arm 4 and the jib 10 are engaged in the enlarged bore sections 14. Each of the gudgeons 15 is axially fixed in the respective enlarged bore section 14 by a collar or flange 16 formed on each of the half-shells 13 near opposite ends thereof which engages in a circumferential groove 17 formed in each gudgeon. One of the gudgeons thus pivotally retains the support arm 4 in one side of the pillow block while the other gudgeon pivotally retains the jib 10 in the opposite side of the pillow block. The gudgeon 15 which projects inwardly from jib 10 further serves to pivotally support therearound a shoulder 18 of the protective housing 7 of the driving motor 6. By this construction, the jib 10 and the support arm 4, including the motor 7 and housing 6 attached thereto, are independently pivotable relative to one another. And, any satisfactory means can be used to individually pivot the jib 10 and the support arm 4. For example, the pivoting means might be a bilaterally actuatable adjusting cylinder (not shown).

In the embodiment shown in FIG. 1, the driving motor 7 drives both the cutting drum 3 and the auxiliary drum 19 via the gear train 8 of the support arm 4. To this end, the gear train 8, which is housed in the support arm 4, extends at one end thereof to the axis of the cutting drum 3 and at the opposite end thereof is extended beyond the axis 24 of the driving motor 7 and up to the pivoting axis 9. At this point, the gear train 8 is connected by gearing to the gear train 21 housed with the auxiliary drum jib 10 by means of a shaft 20 which is led through the bore 12 of the two half-shells 13 of the pillow block 11. Because of its length, the shaft 20 acts like a torsion bar and cushions vibrations which originate from the auxiliary drum 19.

Figure 2:
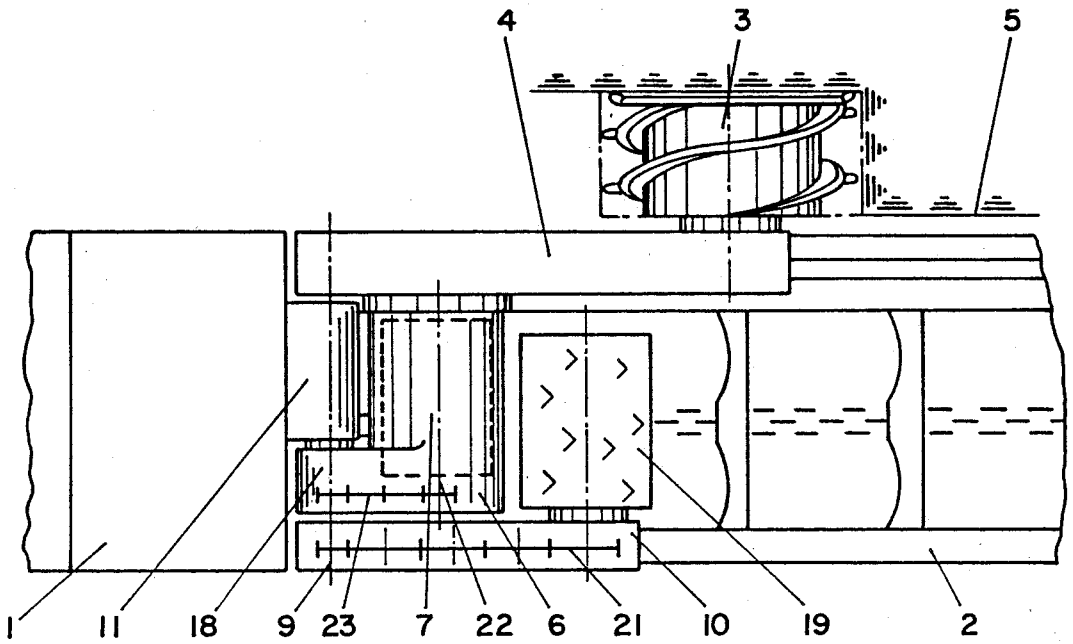
FIG. 2 is a plan view of a second embodiment of the cutter-loader of the present invention.

In the embodiment shown in FIG. 2, the driving motor 7 of the cutting drum 3 acts via a goaf-sided shaft butt 22 extending therefrom to drive gearing 23 which is housed within shoulder 18. The last gear of gearing 23, i.e., the gear which is farthest from the axis of the goaf-sided shaft butt 22, is coaxial with the pivoting axis 9 and is integrally connected with, and hence imparts rotation to, a first end gear of the gear train 21 housed within jib 10. Thus, rotation of driving motor shaft butt 22, through the connection between gearing trains 23 and 21, drives auxiliary drum 19. It should be understood that a coal face sided shaft butt extending from motor 7, but not shown in FIG. 2, drives a gearing train housed within the support arm 4 to rotate the cutting drum 3, as is conventional.

With either embodiment, the full driving power of the high-power driving motor is available to the auxiliary drum while the cutting drum support arm and the auxiliary drum jib are free to pivot about a common pivot axis independently of one another.

While the present invention has been described in accordance with the preferred embodiments of the various figures, it is to be understood that other similar embodiment may be used or modifications and additions may be made to the described embodiment for performing the same functions of the present invention without deviating therefrom. Therefore, the present invention should not be limited to any single embodiment but rather construed in breadth and scope in accordance with the recitation of the appended claims.

I claim:

1. A drum cutter-loader mining machine comprising:
   - a machine body carrying a support arm which rotatably supports a cutting drum, said support arm being pivotally attached to said machine body;
   - a motor for driving said cutting drum, said motor being connected to said cutting drum by gearing;
   - a jib carried by said machine body, said jib being pivotally attached to said machine body and rotatably supporting an auxiliary drum;
   - means for permitting independent pivoting of the support arm and the jib about a common pivot axis; and
   - gear means arranged coaxially with said common pivot axis for producing a geared communication between the auxiliary drum and the motor for driving the cutting drum.

2. The machine of claim 1 wherein said motor is attached at a first side thereof to said support arm at a location between said common pivot axis and said cutting drum, said motor having an axis substantially parallel to said common pivot axis.

3. The machine of claim 2 wherein said gearing connecting said motor and said cutting drum comprises a first gear train, said first gear train extending from an axis of said cutting drum beyond said motor axis to said common pivot axis.

4. The machine of claim 3 further comprising torsion bar means connecting said first gear train with a second gear train associated with said jib for rotating said auxiliary drum, said torsion bar means producing a rotationally elastic communication between said first gear train and said second gear train.

5. The machine of claim 2 further comprising a housing enclosing said motor, said housing including a shoulder at a side of the motor opposite to the side of the motor which is attached to the support arm, said shoulder being pivotally mounted about said common pivot axis.

6. The machine of claim 5 wherein said shoulder is provided with gearing elements connecting a goaf-sided output shaft butt of the motor with a gearing element of the jib which is coaxial with said common pivot axis.

7. The machine of claim 1 wherein said means for permitting independent pivoting of the support arm and the jib comprise pillow block means.

8. The machine of claim 7 wherein said pillow block means comprise:
   - a bipartite pillow block formed of two half-shells divided across their diameter and along their length which are securable to one another,
   - said half shells, when secured to one another, form a through-bore in said pillow block which is coaxial with said common pivot axis,
   - said through-bore being provided at opposite ends thereof with bore sections of enlarged diameter.

9. The machine of claim 8 further comprising a pair of gudgeon means, one of said pair projecting inwardly from said support arm and being axially fixed in a first of said enlarged diameter bore sections, a second of said pair projecting inwardly from said jib and being axially fixed in a second of said enlarged diameter bore sections.

* * * * *